United States Patent [19]

Johnson et al.

[11] 4,311,082

[45] Jan. 19, 1982

[54] GENERAL PURPOSE AUTOMATIC WEAPON SYSTEM

[75] Inventors: Curtis D. Johnson, Wharton; Philip L. Baker, Ogdensburg, both of N.J.

[73] Assignee: The United States of America as represented by the Secretary of the Army, Washington, D.C.

[21] Appl. No.: 255,582

[22] Filed: Apr. 20, 1981

Related U.S. Application Data

[63] Continuation of Ser. No. 48,105, Jun. 13, 1979, abandoned.

[51] Int. Cl.[3] ..... F41D 5/04

[52] U.S. Cl. ..... 89/191 R; 89/33 CA; 89/33 SF; 89/185; 89/198; 89/199

[58] Field of Search ..... 89/191 R, 198, 199, 89/185

[56] References Cited

U.S. PATENT DOCUMENTS

| | | | |
|---|---|---|---|
| 3,999,461 | 12/1976 | Johnson et al. | 89/191 R |
| 4,022,105 | 5/1977 | White | 89/185 |
| 4,191,089 | 3/1980 | Zedrosser | 89/185 |

*Primary Examiner*—Stephen C. Bentley

*Attorney, Agent, or Firm*—Nathan Edelberg; Robert P. Gibson; A. Victor Erkkila

[57] ABSTRACT

There is disclosed a gas operated, fully automatic weapon system with a dual feed mechanism having a long recoil, soft cycle operation. The automatic weapon system consists of six groups or sub-assemblies. These are the backplate (rear end cap/fire control assembly), the dust cover unit, the dual selective rotary feed unit, the operating group unit, the receiver unit, and the barrel unit. These sub-assemblies combine to provide a weapon characterized by lightness of weight, relatively slight recoil force, relatively slow gunfire rate, excellent manual control resulting in good burst fire accuracy in hitting targets, and safety during operation and disassembly.

18 Claims, 21 Drawing Figures

FIG. 8
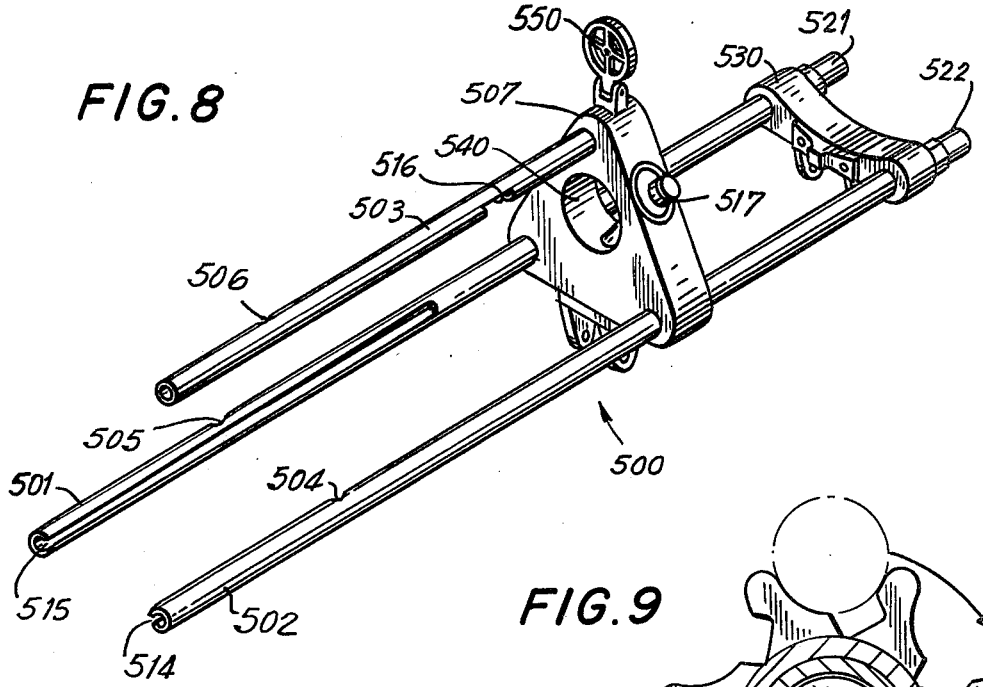
FIG. 9
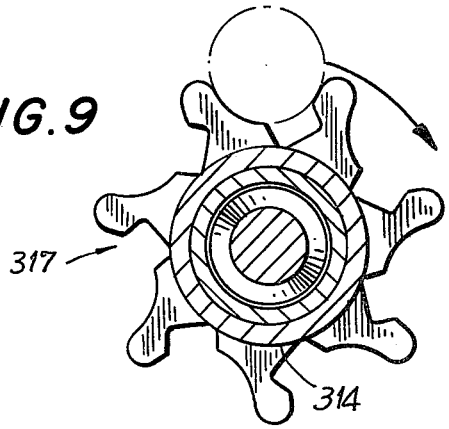
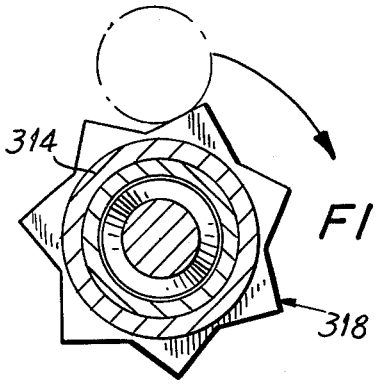
FIG. 10
FIG. 11
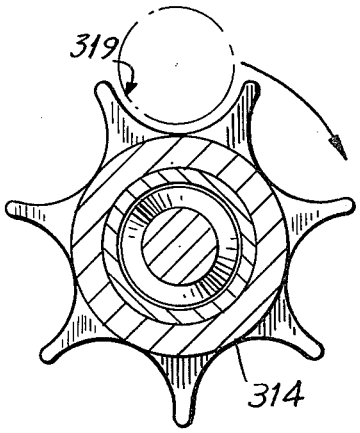
FIG. 7a
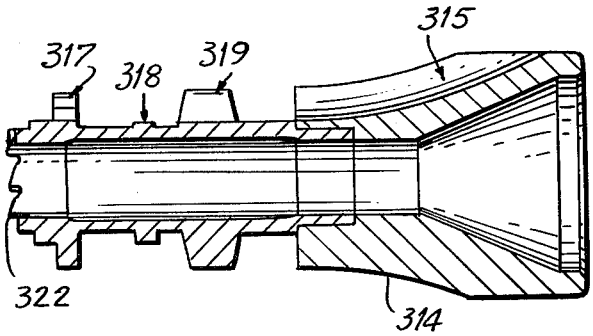

GENERAL PURPOSE AUTOMATIC WEAPON SYSTEM

GOVERNMENT RIGHTS

The invention described herein may be manufactured and/or used by or for the Government for governmental purposes without the payment to me of any royalty thereon.

CROSS REFERENCE TO RELATED APPLICATIONS

This application is a continuation of application Ser. No. 048,105, filed June 13, 1979, abandoned.

BACKGROUND OF THE INVENTION

In recent years great strides have been made in improving automatic gas operated weapon systems of the machine gun genre. New types of ammunition feed mechanisms based on rotary sprocket systems such as disclosed in Johnson et al., U.S. Pat. Nos. 3,999,461 and 4,061,074 have made it possible to significantly decrease the number of parts in and weight of portable machine guns and simplify the replacement of worn out or broken parts, as well as the manufacture of such weapons. Such portable machine guns as disclosed in the Johnson et al., patents have various advantages, such as less recoil displacement with greater control of aim and increased accuracy. The novel design and operation of these machine guns, while manifesting significant advantages, are not completely adaptable to situations where there is a need for a weapon capable of shooting high caliber ammunition, e.g., 50 caliber or higher, from vehicles, such as jeeps, or airplanes, or from tripod mounts. In addition, since the prior weapons contain only one feed mechanism they cannot provide the capability of utilizing different types of ammunition of a specific caliber without switching ammunition belts and possibly gas operating units. Dual feed units which are known are cumbersome to work with, since they require complete disengagement and displacement of one feed mechanism to enable use of the second feed mechanism and, in addition, have relatively primitive gas operating units. The weapon system of this invention provides a dual feed mechanism, as well as other mechanisms which show advantageous properties and capabilities over known weapons, and which will be discussed hereinafter.

SUMMARY OF THE INVENTION

The present invention relates to a gas operated, fully automatic weapon system with a dual feed mechanism having a long recoil, soft cycle of operation. This results in a rate of fire of about 500 rounds per minute, which makes possible good controlability and increased useful life of the weapon. The weapon system of the present invention has relatively few parts, about 160, and is composed of six units or sub-assemblies. The modular design reduces maintenance time and life cycle logistics costs while lower internal working forces mean lower costs of manufacture, materials and maintenance requirements.

The weapon system of the present invention has a dual gas system which halves the load imparted to any individual component and provides two separate and independent power channels evenly spaced about the gun barrel to achieve symmetrical thrust. This uniform thrust shrouds the working elements of the mechanism and mounting points, thereby eliminating eccentric load application to component sub-assemblies and exterior mounting elements. The long/soft recoil cycle in combination with the low restitution hydropneumatic buffer assemblies reduces the rate of fire and loads applied to the gun and gun mounting system, resulting in improved controllability, hit probabilities, and receiver/-component part life. The inventive system achieves, for example, typical firing rates of less than 500 rounds per minute with less than 1,000 pounds of recoil force with 50 caliber ammunition through the gun system mounting points. In addition, the weapon system of this invention is characterized by containing three tubes between the rear end cap and front end cap receiver units. These tubes which are parallel in spaced apart triangular relationship give structure to the weapon. The lower two tubes which support the dual feed assembly enable a selective feed means to be utilized and enable the operator to easily switch from the left hand feed to the right hand feed and vice versa, by pushing or pulling a cross-over bar mechanism and without the need to download the weapon of ammunition.

Briefly, the automatic weapon system of the present invention consists of six groups or sub-assemblies. These are the backplate (read end cap/fire control assembly), the dust cover unit, the dual selective rotary feed unit, the operating group unit, the receiver unit, and the barrel unit. These sub-assemblies, as well as other modular and unitary sub-assemblies can be separately removed from the weapon as individual modules or units and replaced with other corresponding sub-assemblies. This provides for immediate unit level maintenance with minimum weapon down-time and, in addition, provides a means to readily adapt the weapon to ammunitions of different calibers. These sub-assemblies combine to provide a weapon characterized by lightness of weight, relatively slight recoil force, relatively slow gun fire rate, excellent manual control resulting in good burst fire accuracy in hitting targets, and safety during operation and disassembly.

DESCRIPTION OF THE DRAWINGS

FIG. 7*a* is a sectional view of a feed sprocket assembly.

FIG. 8 is the receiver unit.

FIG. 9 is section 9—9 of FIG. 7.

FIG. 10 is section 10—10 of FIG. 7.

FIG. 11 is section 11—11 of FIG. 7.

DETAILED DESCRIPTION OF THE INVENTION

Figure 1:
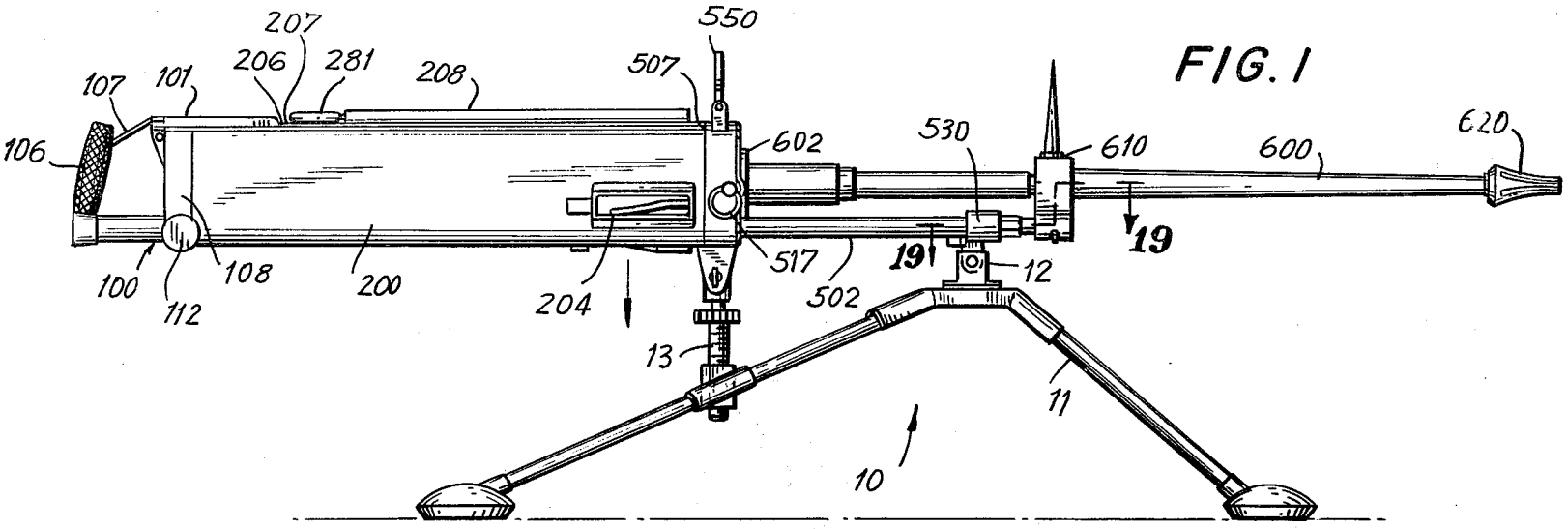
FIG. 1 is a side view of the fully assembled weapon.
Figure 2:
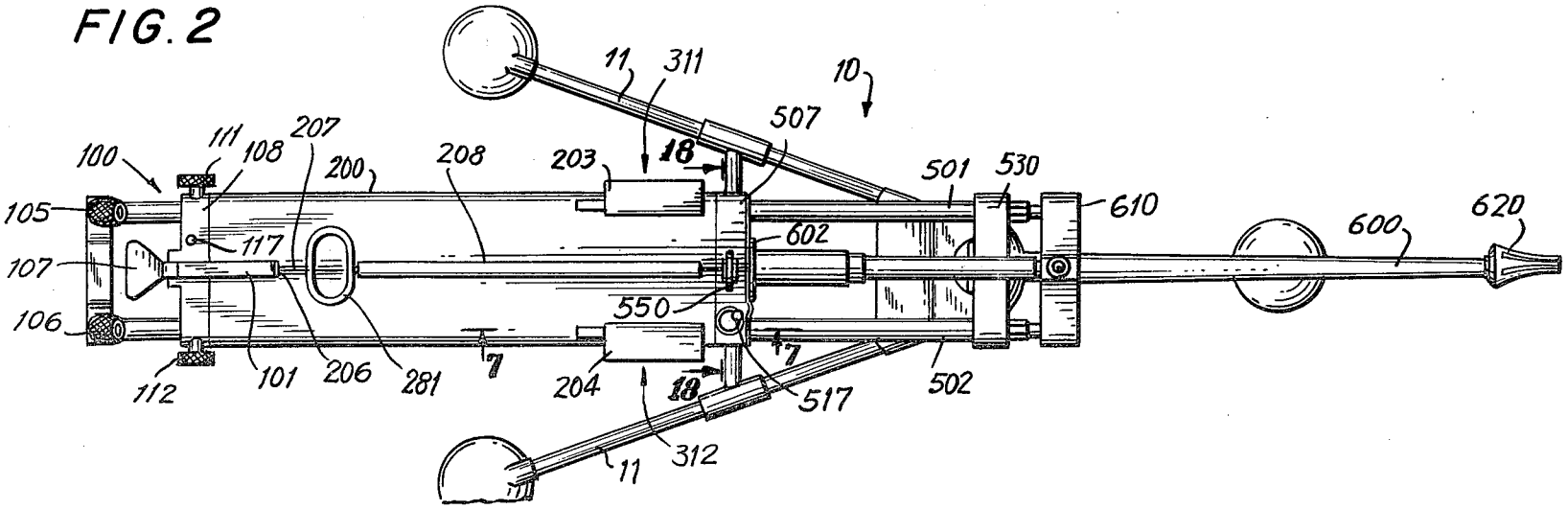
FIG. 2 is a top plan view of the weapon.
Figure 3:
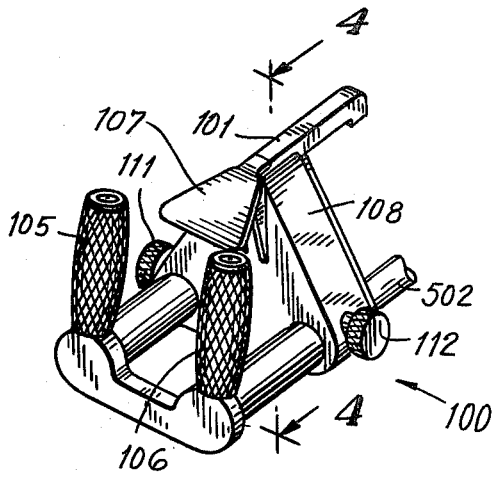
FIG. 3 is a perspective of the back plate group.
Figure 5:
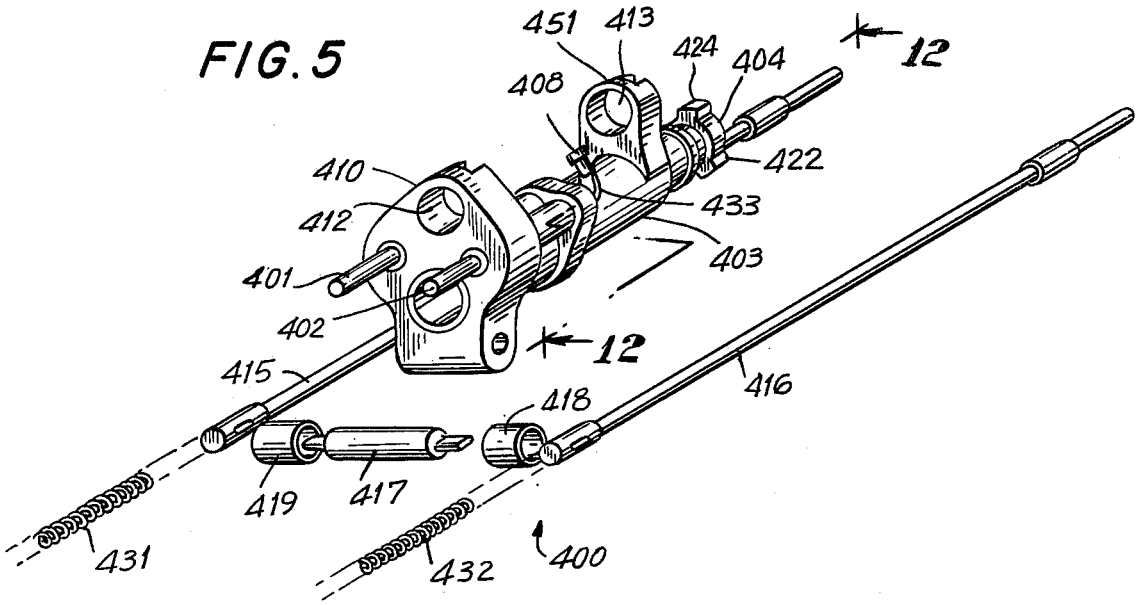
FIG. 5 is a perspective of the operating group unit.

Referring now to the drawings. There is shown in FIGS. 1 and 2 a fully assembled automatic gas operated linked belt fed through a dual feed mechanism machine gun 10 designed for low rate automatic fire. This weapon consists of the back plate unit 100, the dust cover unit 200, the dual selective rotary feed unit 300, FIG. 6, the operating group unit 400, FIG. 5, the receiver unit 500, FIG. 8, and the barrel unit 600.

The weapon is shown on a tripod 11 with a rear tripod adjustor 13.

Figure 4:
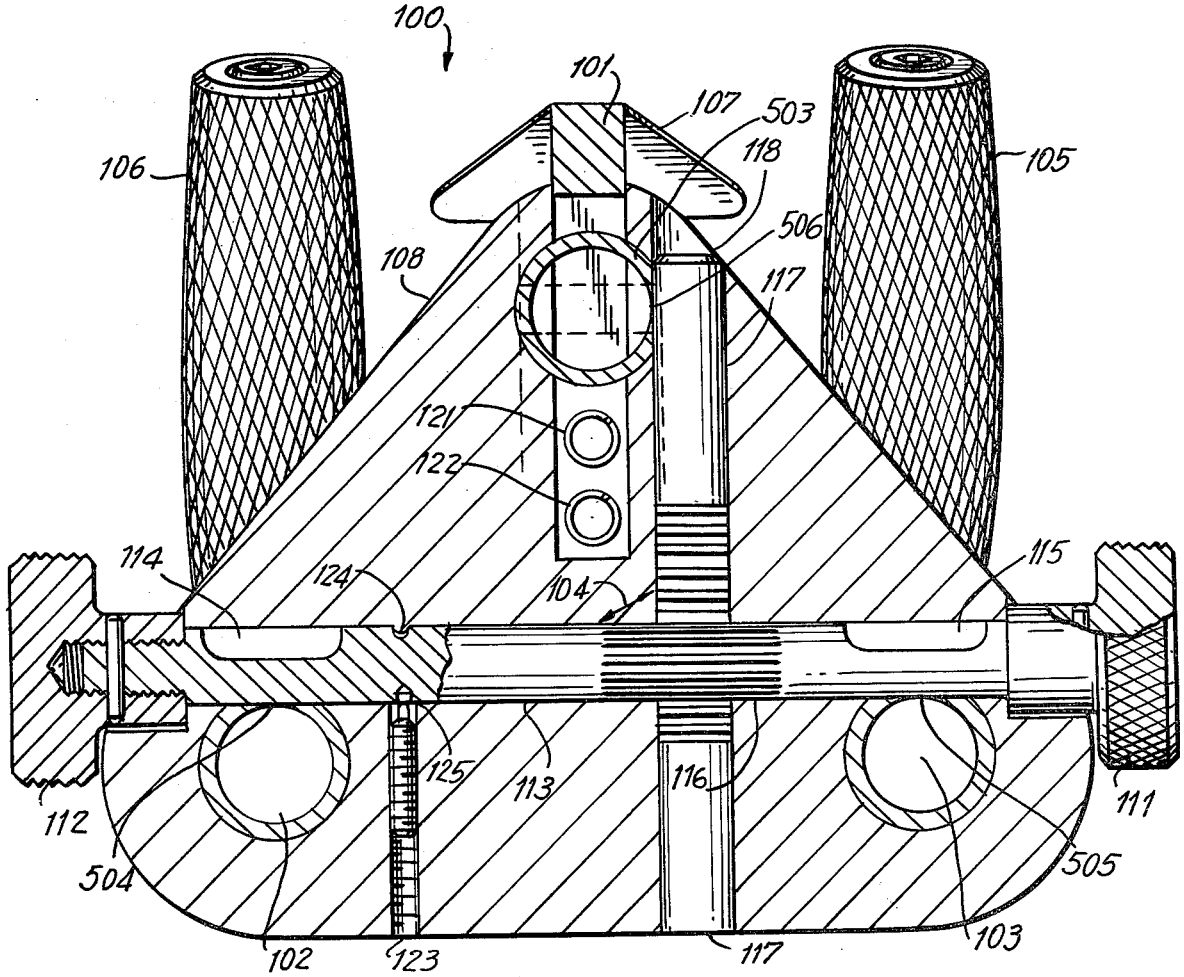
FIG. 4 is section 4—4 of the back plate group of FIG. 3.

The backplate unit 100 comprises the automatic sear 101, the drive spring/lower tube clearance recesses 102, 103 biaxial quick release disassembly mechanism 104, and dual grip 105, 106 gun control device. The backplate 108 functions as the end support for the upper receiver tube 503 and the two lower receiver tubes 501 and 502 shown in FIG. 8. In addition, the backplate 108 receives the thrust of the buffers 401, 402 on the rear yoke 410 of the bolt carrier 403, shown in FIG. 5. The dual hand grips 105 and 106 enable the operator to maintain two-handed control of the weapon and accomplish rapid traverse, elevation, and depression of the pintle 12 mounted weapon. Automatic burst control is accomplished by depressing the butterfly trigger 107 with the thumbs while maintaining the grips 105 and 106 in the hands. The sear 101 can be locked closed with a lockout type safety not shown; this, however, is not required for operation and use of the weapon. When the sear 101 is released, sear springs 121 and 122 shown in FIG. 4 cause the sear 101 to close.

The backplate 108 supports the automatic sear 101 on the top at the center, so that the butterfly shaped trigger 107 thereon can be reached by the operator with the thumbs while holding the dual grips 105, 106. The sear 101 extends forward beyond the front of the backplate 108 and through the dust cover 200 to engage the rear yoke 410 of the bolt carrier 403 and retain the bolt carrier in a rearward position during interrupted burst fire.

The backplate group 100 is a modular device which can be easily removed and replaced. The backplate 108 is removed by turning the knobs 111, 112 on each side of the lower corners; this releases the lower tubes 501, 502. Continued turning of the knobs releases the upper receiver tube 503. The lower tubes 501, 502 and upper receiver tube 503 each have a depression 504, 505, 506 which is engaged by bars 113, 117. The bar 113 is transverse between the knobs 111, 112, and at the depressions 504, 505 in the lower tubes 501, 502, the transverse bar 113 is notched on two portions 114, 115 face the depressions 504, 505 and release the lower tubes 501, 502. In the right hand portion of transverse bar 113 there is a plunger spring 123 which detents the release mechanism in assembled and disassembled positions with notches 124, 125. In the left hand second quadrant of the transverse bar 113 there are gear teeth 116 which engage a vertical bar 117 in a rack and pinion relationship. The vertical bar 117 engages the upper receiver tube 503 at a depression 506 in the side tube 503. When the release knobs 111, 112 are turned, the vertical bar 117 disengages the upper receiver tube 503, releasing it.

A safety factor of the weapon system of this invention is in firing position, since the sear 101 is locked to the rear yoke 410 of the bolt carrier 403 when the weapon is charged, preventing disassembly until the weapon is down loaded and the bolt carrier 403 is released. Thus a significant advantage that this module imparts to the gun is that it prevents disassembly when the gun is charged and loaded, preventing inadvertent firing and the hazardous release of compressed drive springs.

The dust cover unit 200 shown in FIGS. 1 and 2 is a module which has no structural capacities. It is generally triangular in shape and of sufficient length to fit between the backplate 108 and the rear of the receiver end cap 507 in the receiver unit 500.

The dust cover 200 is used to protect the operating group unit 400 from dust and dirt during operation. Forward recesses 203, 204 in the dust cover engage the dual feed box units 301, 302 shown in FIG. 6 while the rear triangular section engages the backplate 108 when fully assembled. There is sufficient fore and aft torsion and axial control in the triangular design to insure protection of the operating parts from the hazards of handling. The dust cover 200 is a light-weight unit similar to that disclosed in the U.S. Pat. No. 3,999,461. There is a notch 206 on the rear portion of the apex of the triangle. This notch provides access of the sear 101 to the rear yoke 410 of the bolt carrier 403. The dust cover 200 also has a slot 207 forward of the notch 206, which provides access to the bolt carrier 403 for a manual charging device 280 shown in FIG. 7. The manual charging device 280 is composed of a handle 281 attached to a chain 282 which engages the bolt carrier 403 by a pin 283 which is attached to retainer 284. The retainer 284 slides in a tubular member 208 attached to the apex of the dust cover 200. The handle 281 is pulled rearward to charge the gun and is returned by spring 285.

Figure 6:
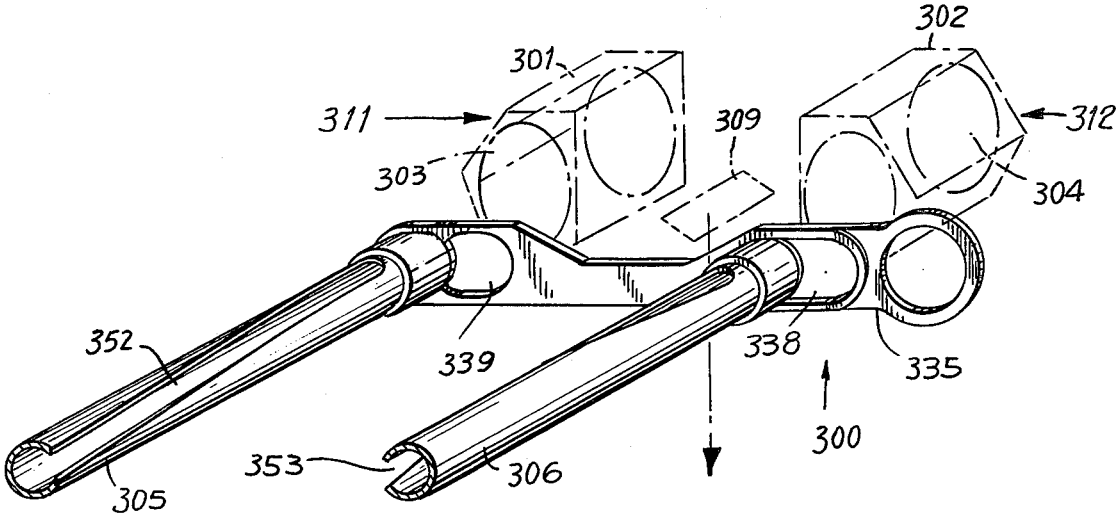
FIG. 6 is a perspective of the dual selective rotary feed assembly.
Figure 7:
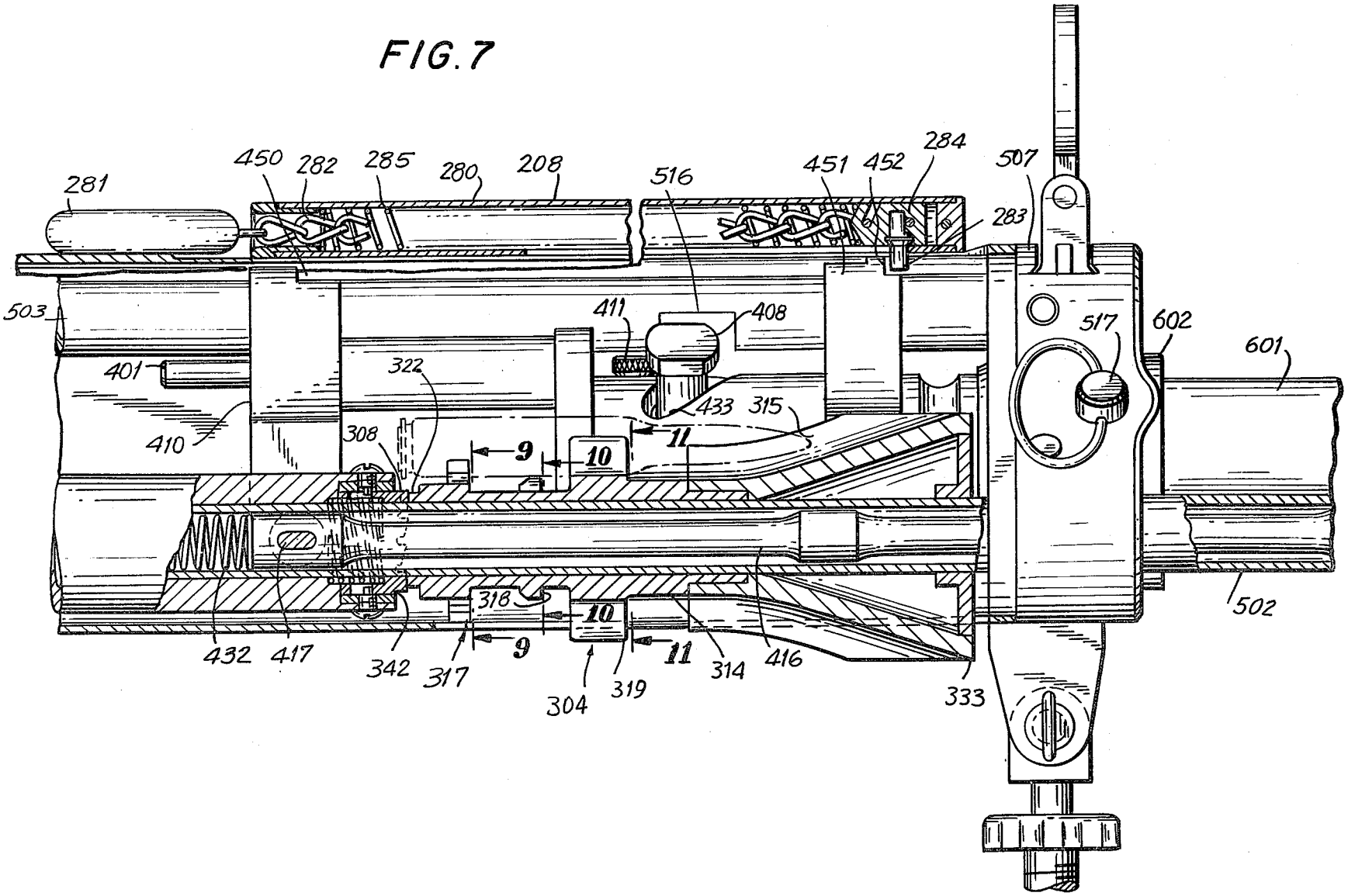
FIG. 7 is section 7—7 of FIG. 2.
Figure 12:
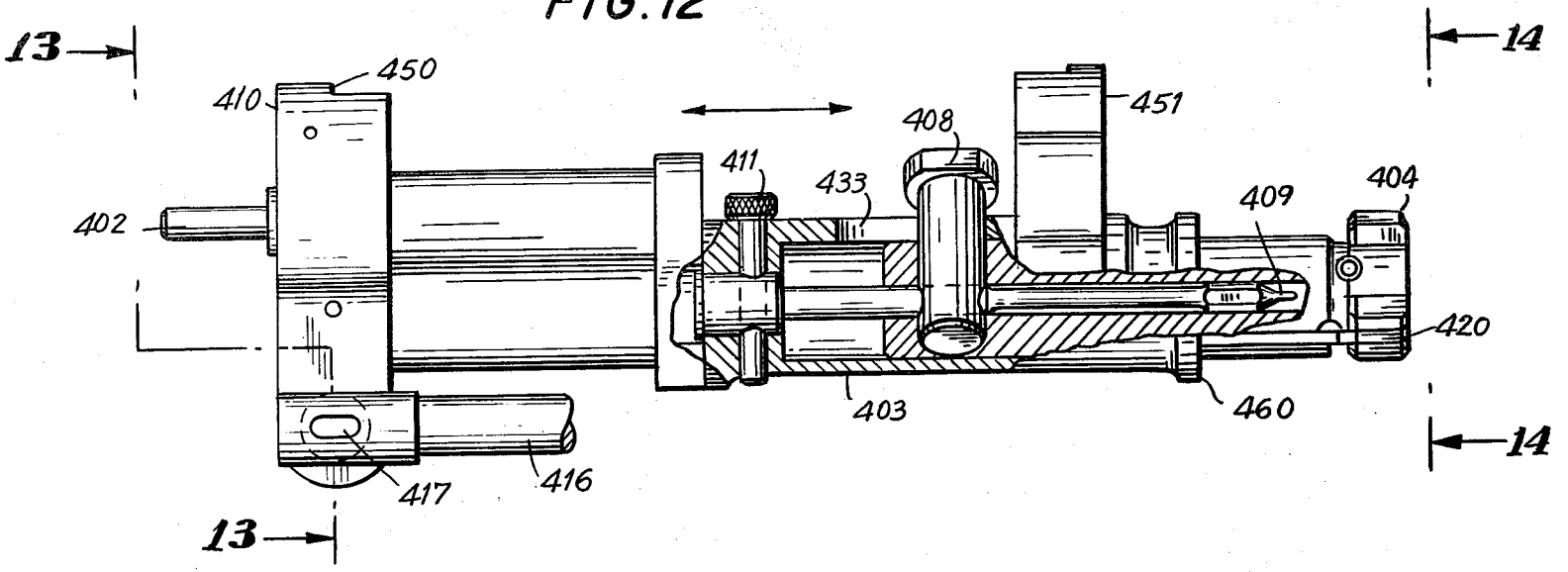
FIG. 12 is section 12—12 of FIG. 5.
Figure 15:
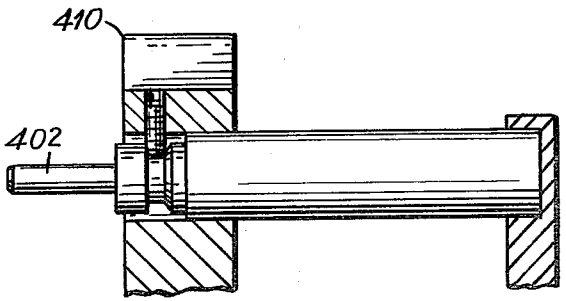
FIG. 15 is section 15—15 of FIG. 13.
Figure 14:
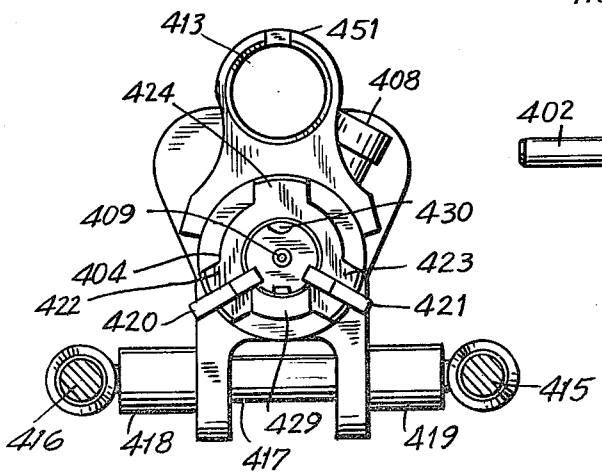
FIG. 14 is section 14—14 of FIG. 12.
Figure 13:
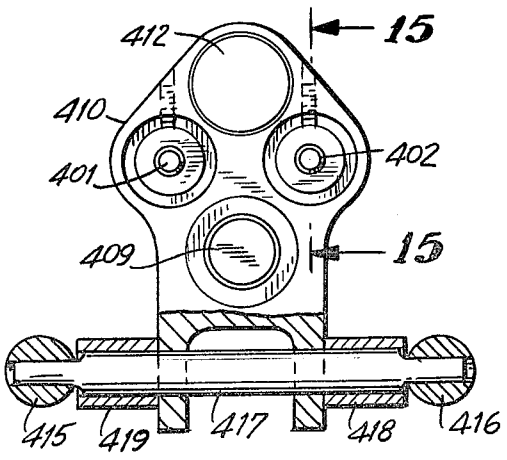
FIG. 13 is section 13—13 of FIG. 12.
Figure 16:
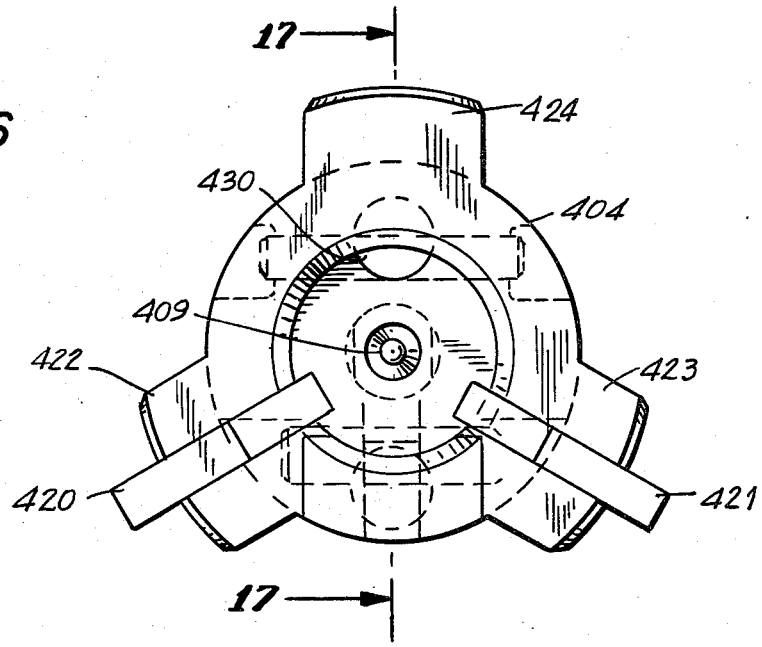
FIG. 16 is enlarged front elevation of the operating group.
Figure 17:
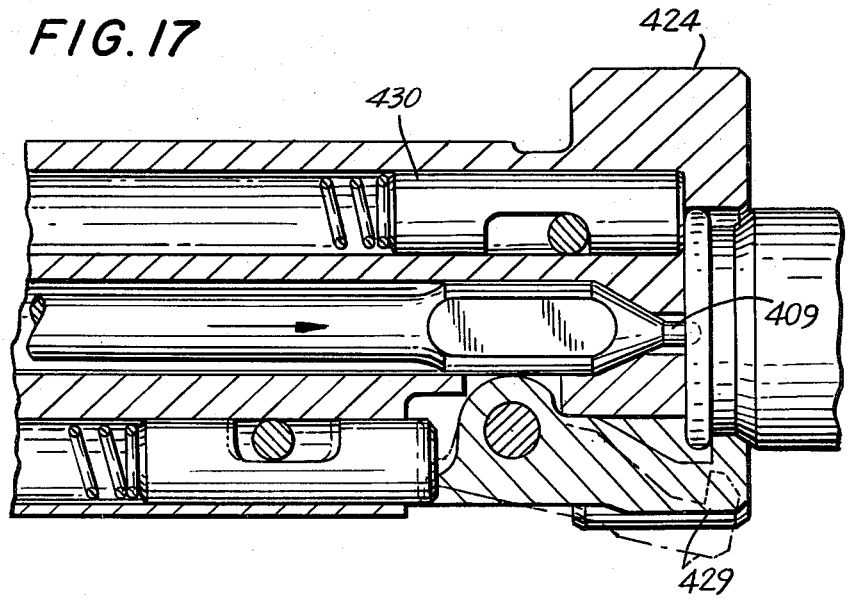
FIG. 17 is section 17—17 of FIG. 16.
Figure 18:
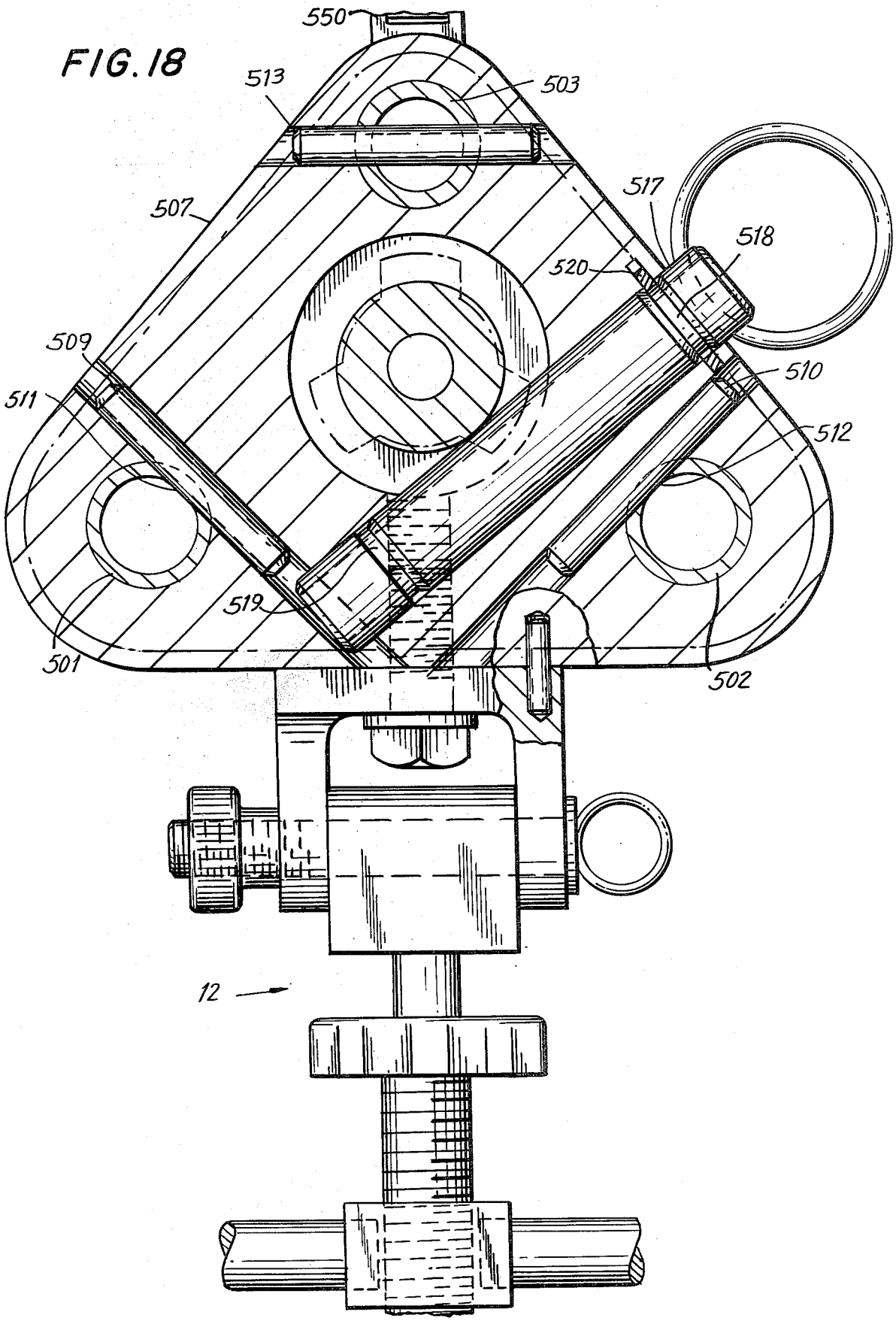
FIG. 18 is section 18—18 of FIG. 2.

The dual selective feed unit 300 shown in FIGS. 6 and 7 is critical to the operation of the weapon system of this invention, since it provides the means to enable the weapon system of this invention to have significant advantage over prior art systems such as described in U.S. Pat. Nos. 3,999,461 and 4,061,074. These prior art systems provide a single feed unit directly below the receiver rod and a rotary ratchet feed assembly which contains several parts rather than a unitary module as provided by this invention. The prior art weapons which contain dual feed units do not provide for selectivity by the operator, since they require a disengagement-engagement operation wherein the feed units are moved manually. This is required in the prior art units because there is no provision for enabling the feed system to idle in place while the other system is operating, as in the present. Both dual selective rotary feed units 303, 304 in feed boxes 301, 302 in the present invention are at the bottom portion of the operating unit 400 and are parallel and form a triangular relationship with the receiver tube 503, which is at the apex of the triangle comprising the feed units 303 and 304 in feed boxes 301, 302 and the receiver tube 503. These dual selective rotary feed units 300 are improvements and adaptations of those disclosed in U.S. Pat. No. 4,061,074. A dual selective feed unit 300 is comprised of two receiver tubes 501, 502 which are inserted into the backplate 108 in the two openings 102, 103, in the bottom corners of the triangular backplate 108. The receiver end cap 507, FIGS. 7, 8, and 18, holds the receiver feed tubes 501, 502 in place by pins 509, 510 in depressions 511, 512 not shown in the tubes 501, 502 and tube 503 by pin 513. These tubes 501, 502 are hollow and each has a lengthwise slot 514, 515. These slots 514, 515 begin at the backplate 108 and end just rearward of the receiver end cap 507. The slots 514, 515 provide tracks for the drive pin 417 and thus enable carrier 403 to move from rear to front to discharge the weapon and from front to rear to charge the weapon, as will be explained hereinafter.

A feed unit either right or left hand, consists of a harmonic feed cam/ratcheting assembly 305, 306 receiver tubes 501, 502 drive ratchet assemblies 307, 308 and a feed box assembly 301, 302. The feed box assemblies 301, 302 have incoming ammunition slots 311, 312 and as ejection port 309 to eject the spent cartridge cases in the direction of the arrow. The harmonic feed cam/ratcheting assembly 305, 306 and feed box assemblies 301, 302 telescope on the lower feed/powering tubes 501, 502 and are confined by the assembled receiver end cap 507 and backplate 108. Feed covers, not shown, which guide the incoming linked ammunition, pivot on the receiver end cap 507 and latch to the feed box 301, 302 for purposes of loading and down loading. The feed box assembly 301, 302 consists of a feed sprocket 313, 314 (FIGS. 7 and 7*a*), anti-backup pawl, not shown, end cap positioning lugs not shown, and feed cover latching mechanism not shown. This assembly is an improvement over the prior art exemplified by U.S. Pat. No. 4,061,074, since the feed sprockets 313, 314 are unitary devices which receive a round of ammunition from the belt not shown and guides it into the barrel 600 of the weapon, whereas the previous device had a guide spring. The unitary feed sprockets 313, 314 can be disassembled from the weapon and replaced by other such devices which are adapted to receive a different size ammunition. This adaptation is accomplished by varying the number of possible round positions or pitches on the feed sprockets 313, 314 given the same dimensional relationships between centerline of barrel 600 and receiver tubes 501, 502, 503.

These devices 313, 314 contain round and link control guides 317, 318, 319 and a bell shaped portion 333 in front. The bell shaped portion contains circular grooves 315 which serve as guide ramps for the round of ammunition being fed. The feed sprocket assemblies 313, 314 rotate inwardly from the top during recoil, placing a round of ammunition in feed position. During counter recoil, the feed sprocket assemblies 313, 314 remain stationary, and the base of the cartridge being fed is contacted by one of the rammers 420, 421 housed in the lower two lugs 422, 423 of the bolt 404. As the bolt 404 continues moving forward, the round is stripped from its link and is guided by the grooved ramp 315 which aligns the bullet of the round with one of the lower lug openings 611, 612 of the barrel extension 602. These assemblies also can be adapted for use in other rotary feed weapons such as the portable weapons described in U.S. Pat. Nos. 3,999,461 and 4,061,074, which weapons are useful for smaller than 50 caliber bullets.

Another significant aspect of the dual selective feed unit 300 is that it permits the operator to switch from right hand feed to left hand feed and vice versa, by simply moving a sliding bar 335, which is a novel aspect of this invention, which can also be used to disengage both feeders simultaneously. This is important because if the gun malfunctions or breaks down the only way to immediately stop unwanted firing may be to disengage the dual feed units 303, 304. The feed units 303, 304 are designed so the spring loaded feed ratchets 307, 308 in the feed cam assemblies 305, 306 can be disengaged from ratchets 321, 322 on the sprocket 313, 314 by inserting a device between the two to separate them slightly. This is accomplished by the sliding bar 335, which is thicker on its ends than in the central portion. The bar has transverse openings 338, 339 wide enough to accommodate the ratchet diameters of the sprockets 313, 314 and ratchets 307, 308. When the bar 335 is pushed sideways, pressure is applied on the shoulders 341, 342 and causes them to move rearward, disengaging the ratchets on one or both feed units 303, 304, depending on the position of the position of the bar 335 after it is pushed.

The operating group unit 400 comprises a bolt carrier 403 which is similar to that disclosed in the U.S. Pat. No. 3,999,461. Thus, as the weapon is fired the drive springs 431, 432 displace the bolt carrier 403 and bolt 404 forward, causing the round to be pushed into the barrel extension 602 by the rammers 420, 421. As the bolt 404 continues forward, the three bolt lugs 422, 423, 424 pass through corresponding openings 611, 612, 613 in the barrel extension 602. The lugs 422, 423, 424 then contact a surface, not shown, in the barrel extension 602, stopping forward motion of the bolt 404. The bolt carrier 403 continues moving, causing the cam pin 408 to ride in cam 433, turning the bolt 404 so that the lugs 422, 423, 424 are rotated into a locked position inside the barrel extension 602. There exists a notch 516 in the upper receiver tube 503 which allows the cam pin 408 and thus the bolt 404 to rotate during interaction with cam 433.

The motion of the bolt carrier 403 is stopped when the forward shoulder 460 contacts the rear of the barrel extension 602. As this occurs, the tip of the firing pin 409 impacts the primer in the cartridge, causing ignition of the cartridge propellant. The resultant high pressure gases propel the bullet down the barrel 601.

The rear yoke 410 of the bolt carrier has two hydropneumatic buffer units 401, 402 which aid in reducing the gun length, since there is no need for a buffer in the back plate, and increasing the mass of the operating group 400 without increasing the total weapon mass. The increase in the mass of the operating group 400 from the buffing system serves to increase reliability under adverse conditions and reduce the natural rate of fire to the desired range of less than 500 shots per minute.

The firing pin 409 is held in place within the bolt carrier 403 by pin 411. This pin 411 is kept in place by the upper receiver tube 503. The receiver tube 503 also acts as a support upon which the bolt carrier 403 slides during recoil and counter-recoil. The bolt carrier 403 has openings 412, 413 in the top of the front yoke 451 and rear yoke 410 for receiving the upper receiver tube 503.

The operating group unit 400 contains two interchangeable hollow operating rods 415, 416 attached to the bolt carrier rear yoke 410 by a transverse power transmission pin 417 attached to the operating rods 415, 416. On each end of the pin 417 outside the bolt carrier rear yoke 410 but inside the operating rods 415, 416, there are rollers 418, 419 which actuate the feed cams 305, 306 as they move longitudinally in the harmonic cam paths 352, 353. Slots 514, 515 in the lower receiver tubes 501, 502 permit assembly and movement of the operating group within the receiver 500.

Figure 19:
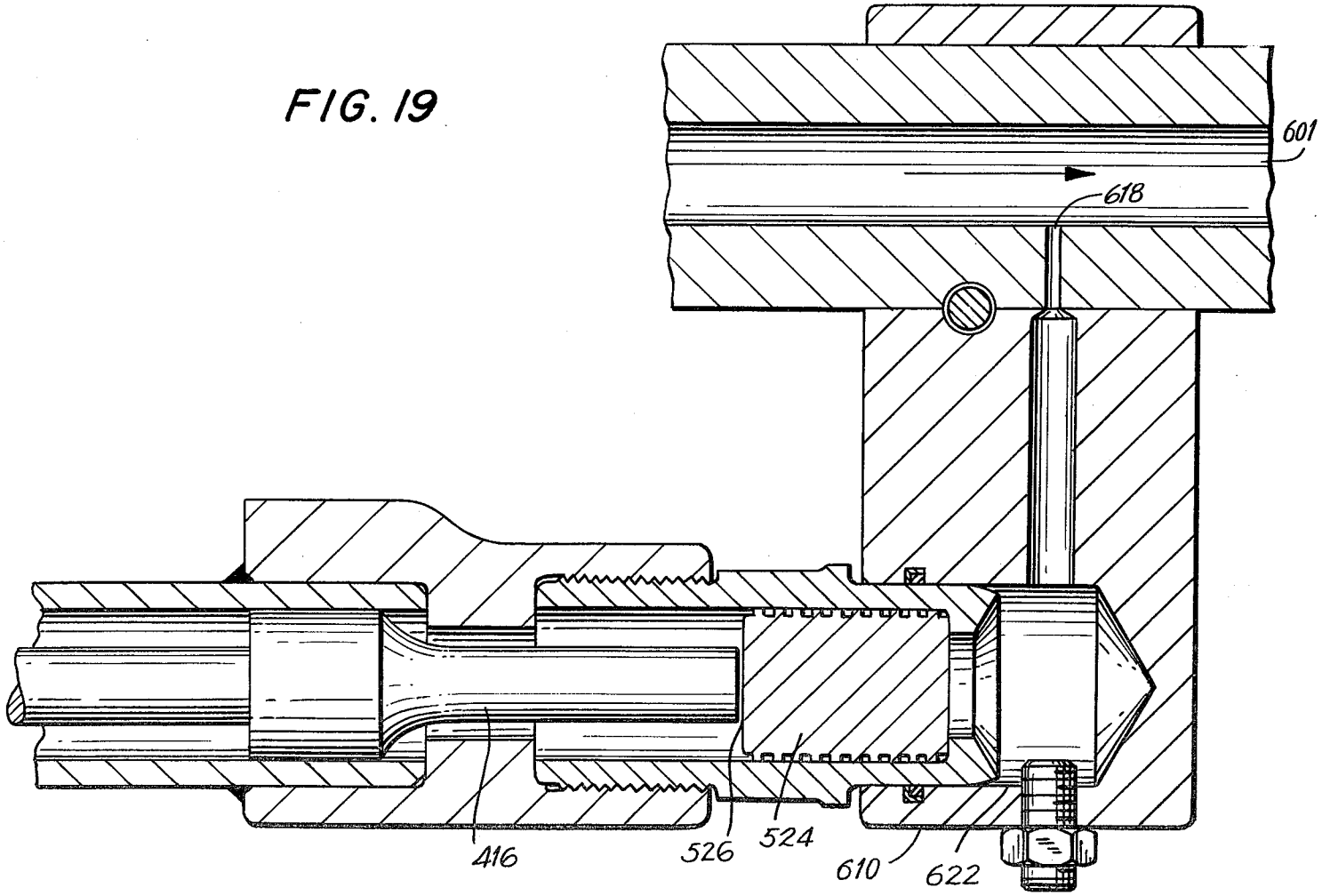
FIG. 19 is section 19—19 of FIG. 1.
Figure 20:
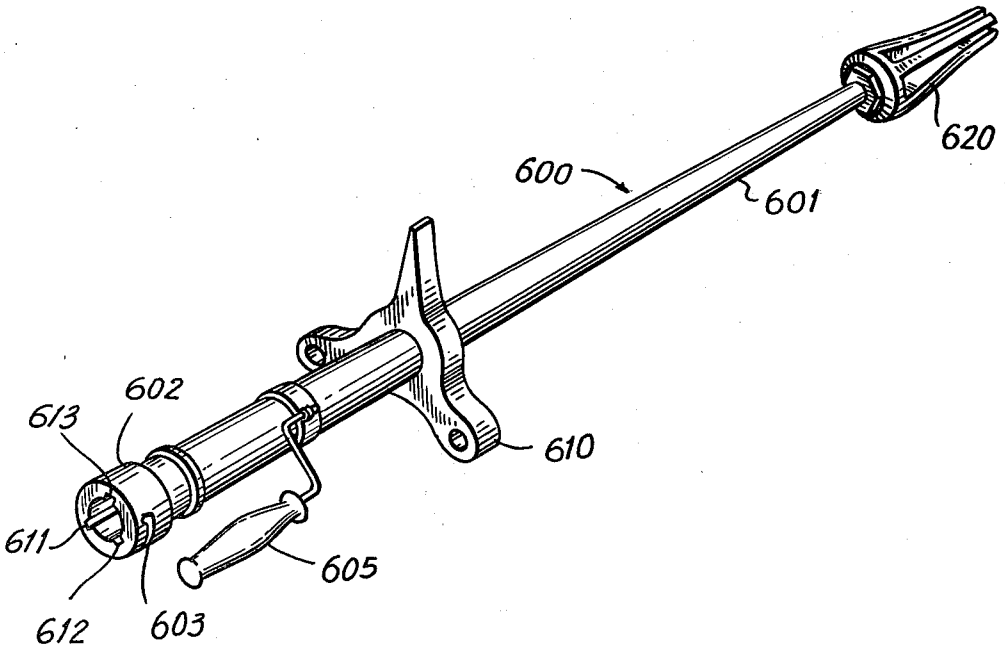
FIG. 20 is a perspective of the barrel group.

The operating group 400 recoils after the round is fired. This occurs when the gases formed during firing enter the gas housing 610, FIG. 19, through gas ports 617, 618 in the barrel 601 and actuate the pistons 523, 524 in the tappet gas interface 525, 526 at forward ends of the operating rods 415, 416. This drives the rods rearward causing the drive pin 417 and the rollers 418, 419 and thus the bolt carrier 403 to move rearward. When the bolt carrier 403 is forced rearward, the locking/unlocking cam pin 408 is turned by the cam 433 through the notch 516 in the receiver tube 503, unlocking the bolt 404 from the barrel extension 602. As the rollers 418, 419 ride rearward in the cam paths 352, 353 of the feed cams 305, 306, the feed mechanisms 303, 304 are actuated and place the next round in position. During recoil of the operating group 400, the spent cartridge case is extracted from the barrel chamber and ejected from the weapon by coventional extractor 429 and ejector 430 systems housed in the bolt 404.

The receiver unit 500 contains three elongated hollow tubes 501, 502, 503. The upper tube 503 is unslotted and bridges the receiver end cap 507 and backplate 108. The upper tube 503 imparts extra structural integrity to the weapon. In addition, this upper tube 503 provides axial guideways for the bolt carrier 403, retains pin 411 and thus prevents accidental disassembly of the firing pin 409, cam pin 408, and bolt 404 from the bolt carrier 403, and insures that the bolt 404 is in the forward position until the locking/unlocking cycle, at which time the cam pin 408 is oriented to clear the notch 516. It is important that the notch 516 be in the proper position so the timing is correct for the bolt 404 to lock/unlock.

The two lower tubes 501, 502 are slotted 514, 515 in order to accommodate the drive powering pin 417 and the slotted feed cams 305, 306 which are housed on the exterior of the lower tubes 501, 502. A forward tube guide 530 is integrally mounted on the lower tubes 501, 502, cradles the barrel assembly 600 and inserts its dual tappet gas systems 521, 522 into the sealing recesses 621, 622 of the gas housing 610. Power is transmitted through the operating rods 415, 416 drive pin 417 and rollers 418, 419 to operate the dual selective rotary feed systems 303, 304 mounted on each lower rod 501, 502. Energy stored in the recoil springs 431, 432 is sufficient to complete the counter-recoil cycle.

The receiver end cap 507 receives the barrel extension 602 and incorporates the barrel lock/release pin 517, which engages a recess 603 in the barrel extension 602, locking it in place. The barrel assembly 600 is unlocked by pulling the pin 517 outward. This is a safety feature, since the operator knows whether the barrel is unlocked by observing the position of the pin 517. The barrel release pin 517 is retained at either the locked or unlocked position by the interaction of a retaining ring 520 with two grooves 518, 519 in the pin 517. A barrel handle 605 is used to remove the barrel 601, which might be hot. The receiver end cap unit 507, in addition, contains the rear sight unit 550 integrally mounted on its apex.

The two lower slotted tubes 501, 502 and the upper receiver tube 503 are recessed in the portion which is received by the backplate 108. These recesses 504, 505 and 506 receive the pins 113 and 117 which lock the tubes in place.

The two lower tubes 501, 502 are fixed into and through the receiver end cap 507 by pins 509 and 510. The tubes 501, 502 extend forward of the end cap 507 to the tube guide 530, which engages the dual tappet gas systems 521, 522. The motion imported by these systems 521, 522 provides a uniform thrust through the cores of the twin tubes 501, 502 to the operating parts for dual uniform gas system operation. The upper receiver tube 503 is fixed into the receiver end cap 507 by pin 513.

The barrel unit 600 is received in the receiver end cap 507. The gas housings/front sight unit 610 is an integral part of the barrel 600. The barrel 600 has a barrel handle 605 for easy removal when disassembled and a flash suppressor 620 on its forward end. The gas housing 610 has two ports 617, 618 and recesses 621, 622 for interface with the dual tappet gas systems 521, 522. The barrel 600 can be removed and replaced with another barrel suitable for shooting cartridges of a different caliber and the weapon is adaptable for use with bullets of from 50 caliber to 20 millimeters. When changing the weapon from 50 caliber to 20 millimeters, or vice versa, only four parts need to be changed, the feed box assemblies 301, 302, the feed cams 305, 306, the the bolt 404, and the barrel 600. When the change involves a common cartridge case, only the barrel 600 needs to be changed. The gas ports 617, 618 automatically are engineered for each barrel, so that the recoil powering thrust remains constant, no matter which caliber bullet is used.

DESCRIPTION OF PREFERRED EMBODIMENT

In order to further understand this invention, it will be described by referring to the drawings and describing the operations of a weapon which is within the scope of the invention.

In order to initially charge the weapon, the bolt carrier 403 is pulled to the rear by means of the charge handle 281 attached by a chain 282 to a pin 283 by a retainer 284. The pin 283 hooks a notch 452 in the front yoke 451 of the bolt carrier 403. When the operating group is moved to the charge position, the ratchet 307, 308 of the engaged feed cam 305, 306 rotates from outside bottom to top for a distance sufficient to move, by means of the engaged ratchet teeth 307 and 321, 308, and 322, the unitary feed sprocket 313, 314 to place a cartridge from the ammunition feed belt into a position to be rammed by the rammers 420, 421 through the barrel extension 602 into the chamber when the bolt 404 counter recoils. The reciprocating motion causes the rotary movement of the feed cams 305, 306 by means of rollers 418, 419 on a transverse pin 417 in the rear yoke 410 of the bolt carrier 403 riding in the cam slots 352, 353 of the feed cam assembly 305, 306. The ammunition feed mechanisms, both right 304 and left 303 each include a sprocket 313, 314 having cartridge feeding and positioning splines 317, 318, 319. The sprockets rotate from outside bottom to top into the feed position to move a belt of linked cartridges into position for chambering and firing. Stop cam pawls, not shown, prevent counter-rotations and maintain the sprockets 313, 314 in position while a cartridge is chambered. Either a left 303 or right 304 feed operates, not both of them simultaneously. This is accomplished by a sliding device 335 which, when moved to the right, causes shoulder 341 on the drive ratchet 307 on the left feed cam assembly 305 to be pushed to the rear, disengaging the ratchet 307 from the sprocket mechanism 313. The sliding bar 335 can be moved part way, causing both left and right ratchets 307, 308 to become disengaged, with the result both left and right feeds 303, 304 are in idle position and the gun cannot fire.

The rotation of the sprockets 313, 314 for feeding is done with cam tube actuator ratchets 307, 308 making connection with ratchet teeth 321, 322 on the sprockets 313, 314. The bolt 404 has depressible rammer 420, 421 for chambering the cartridges. The bolt 404 has a pin 408 which rotably engages the cam 433 when the pin 408 is freed by a notch 516 in the tube 503, causing the bolt 404 to rotate to a position in which it becomes locked to the barrel extension 602 during firing.

Immediately after a cartridge is chambered, the firing pin 409 in the bolt carrier 403 fires the cartridge. As the projectile passes through the barrel 601, gases pass through openings 617, 618 in the barrel 601 to the gas housing 610 to produce pressure against pistons 523, 524 moving them rearwardly and exerting force which drives the operating rods 415, 416 rearward, causing the bolt carrier assembly 403 to recoil and the next round to be moved into position for firing, as explained above. Rearward movement of the operating rods 415, 416 causes compression of and thus energy to be stored in the springs 431, 432 which are in the rear portion of the lower feed tubes 501, 502, between the operating rods 415, 416 and the backplate 108. When the trigger 107 is depressed, the bolt carrier 403 is disengaged and the unit springs forward, guided by the receiver tube 503. These actions just described are the mode by which the weapon of this invention operates.

It should be understood that when two numbers are used for a part on the drawings and only one number is shown, the other number is the corresponding right or left of the pair.

We claim:

1. A gas operated gun comprising:

a gun barrel adapted to contain a gas under pressure for propelling a projectile through said barrel, a receiver having three elongate substantially parallel hollow tubes in a triangular pattern of relationship, each of said tubes having oppositively directed fore and aft ends, one of said tubes being uppermost and two of said tubes being lowermost and mutually coplanar, said receiver further having rear and front end cap means connected to each of said tubes for securing said tubes fixedly in said triangular relationship, said front end cap means having means for securing said gun barrel between said tubes, elongate force-transmitting means including operating rods longitudinally movable within each of said two lowermost tubes, gas cylinder means connected between said gun barrel and said force transmitting means in each of said two lowermost tubes, for applying force generated from said gas under pressure to said force-transmitting means, and a bolt carrier assembly slidably mounted on one of said tubes uppermost in relation to said lowermost tubes, said bolt carrier assembly being adapted to move a cartridge into said barrel to fire said cartridge and be forced rearwardly toward said rear end cap means by said force-transmitting means during recoil after said cartridge is fired.

2. A gas operated gun according to claim 1, further including:

locking means for securing said bolt carrier assembly in locked relationship with said barrel when said cartridge is in said barrel, and unlocking means on said bolt carrier assembly operatively connected to said force-transmitting means for unlocking said locking means to permit said rearward recoil movement of said bolt carrier assembly after said cartridge is fired.

3. A gas operated gun according to claim 2, wherein said bolt carrier assembly includes:

a locking cam arcuate slot, and a bolt rotatably mounted in said bolt carrier and containing a cam pin extending into said slot, for rotating said bolt during recoil to effect unlocking and rotating said bolt during countercoil to effect locking thereof to said barrel.

4. A gas operated gun according to claim 3, wherein said uppermost tube is operatively interrelated with said cam pin and contains a notch means for passage of said cam pin to provide positive control and timing of the locking and unlocking of said bolt.

5. A gas operated gun according to claim 1, further including a feeder means mounted on said receiver and operatively connected to said force-transmitting means, for feeding a succession of cartridges to said bolt carrier assembly for sequential firing in said barrel.

6. A gas operated gun according to claim 5, wherein said feeder means includes a dual selective cartridge feeder mechanism comprising a disengageable ratchet means rotatably mounted on each of said lowermost receiver tubes, and a transverse drive pin means operatively connecting said force-transmitting means with said feeder mechanism and said bolt carrier assembly to cause rotation of said ratchet means upon movement of said force-transmitting means.

7. A gas operated gun as set forth in claim 6, wherein each of said disengageable ratchet means includes a unitary feed sprocket cartridge guide having ratchet teeth on the rear thereof and a feed cam tube having an arcuate slot therein, said cam tubes and feed sprockets being rotatably mounted on said lowermost elongate tubes, each of said feed cam tubes being attached to ratchet teeth on the forward portion thereof operatively engageable to said feed sprocket ratchet teeth, said feed cam tubes having a slidable ratcheting device containing said ratchet teeth operatively attached thereto and separable from said feed sprocket ratchet teeth, and means to move said ratcheting device to separate said ratchet teeth, wherein said transverse drive pin means extends into said arcuate slots to cause rotation of said cam tubes as said transverse pin means moves along said slots in response to gas pressure applied to said force-transmitting means.

8. A gas operated gun as set forth in claim 7 wherein said means to move said ratcheting device to separate said ratchet teeth comprises a feed cross-over device containing openings therein and being in sliding relationship with said ratcheting devices, said cross-over device being moveable left to right, and vice versa, against one or both of said ratcheting devices on the feed cam tubes to disengage or engage the feed ratchets which rotate the feed sprocket-cartridge guides.

9. A gas operated gun according to claim 7, wherein said feed sprocket cartridge guide is of greater diameter at its forward end than at its rearward end, said rearward end containing ratchet teeth and a sprocket for receiving cartridges and said forward end containing grooves on its slope for cradling and guiding the cartridges into the barrel.

10. A gas operated gun as set forth in claim 1 wherein said three tu are removeably attached, by a rack and pinion mechanism, to said rear end cap means containing dual handgrips and a sear.

11. A gas operated gun as set forth in claim 1 wherein the bolt carrier assembly has hydropneumatic buffers to absorb recoil forces when said bolt carrier assembly recoils to said rear end cap means.

12. A modular light weight automatic weapon system comprising:

a receiver including three parallel elongate hollow tubes spaced apart in a triangular relationship, connected at the rearward end by a receiver end cap containing orifices with locking means for said tubes, and at the forward end by a receiver end cap containing an orifice with locking means for the uppermost tube at the apex of the triangle and passthrough orifices with locking means for the two lowermost tubes, said forward end cap having, substantially in the center thereof, an orifice for receiving a gun barrel and having barrel locking means, a gun barrel having a bore through which a fired projectile passes, said barrel having a barrel extension held by said forward end cap and having a gas housing connected to the lowermost tubes, said gas housing having orifices interconnecting said bore and said lowermost tubes, a bolt carrier assembly slidably mounted on said uppermost tube, operating rods slidably mounted inside said lowermost tubes and operatively connected by a transverse drive pin to said bolt carrier assembly and to a dual selective cartridge feeder means, said bolt carrier assembly being operable when moved forwardly to move a cartridge into said barrel extension and maintain itself locked thereto until said cartridge is fired, said operating rods being actuated by gases in said bore to move said bolt carrier rearwardly, and dual cartridge feeder means for indexing a cartridge in position for movement into said barrel extension selectively from either the right hand or left hand feed sprocket, said dual cartridge feeder means comprising disengageable ratchet means rotatably mounted on each of said lowermost tubes, each of said disengageable ratchet means including a cartridge feed sprocket guide having ratchet teeth on the rear thereof and a feed cam tube having an arcuate slot thereon and ratchet teeth operatively engageable to said feed sprocket ratchet teeth, wherein said transverse drive pin extends into said arcuate slots to cause rotation of said cam tube and feed sprocket as said pin moves along said slots in response to gas pressure applied to said operating rods.

13. A modular automatic weapon system as set forth in claim 12 wherein gas cylinders containing pistons therein interconnect said gas housing to said lowermost tubes, said pistons being operable by said gas to push said operating rods and bolt assembly rearwardly.

14. A modular automatic weapon system as set forth in claim 12 including counter-recoil springs in said lowermost tubes to move said operating rods and bolt carrier assembly forward after rearward motion of said rods and bolt carrier assembly has been terminated.

15. A modular automatic weapon system as set forth in claim 12 wherein the dual feed system supplies cartridges from only one feed sprocket at a time and the selection thereof is controlled by a sliding device operatively positioned rearward of the said feed sprocket and forward of said feed cam tube in order to engage or disengage said ratchet teeth.

16. A modular automatic weapon system as set forth in claim 12, wherein said receiver rear end cap has a quick releasing mechanism for said uppermost and lowermost tubes including pins in a rack and pinion relationship, said pins holding said tubes by grooves in said tubes and releasing said tubes by being rotated to disengage said tubes.

17. A modular automatic weapon system as set forth in claim 12 including means to release the barrel from the front end cap comprising a movable pin in said end cap which engages said barrel by a notch, said pin being movable by pulling outward from said barrel.

18. A gas operated gun comprising:

a gun barrel adapted to contain a gas under pressure for propelling a projectile through said barrel;

a receiver having three elongated hollow tubes substantially parallel and in triangular relationship secured in spaced apart relationship to front and rear receiver end caps, the two lowermost of said tubes which pass through the front receiver end cap being on substantially the same horizontal plane and the uppermost of said tubes, which terminates at said front receiver end cap, being at the apex of a triangle formed by the three tubes, and means of securing said gun barrel fixedly to said front receiver end cap substantially centered between said three tubes;

elongate force-transmitting means including operating rods longitudinally moveable within each of said lowermost tubes;

gas cylinder means connected between said gun barrel and said force-transmitting means, for applying force generated from said gas under pressure to said force-transmitting means;

a bolt carrier assembly slidably mounted on said uppermost tube, a cartridge feeder mechanism rotatably mounted on each of said lowermost tubes;

a transverse drive pin means operatively interconnecting said operating rods with said feeder mechanisms and said bolt carrier assembly to cause movement of said bolt carrier and rotation of said feed mechanisms upon movement of said operating rods, and means operatively connected to said feed mechanisms to selectively disengage one or both of said feed mechanisms.

* * * * *